US009914896B2

(12) United States Patent
Eisenberg et al.

(10) Patent No.: US 9,914,896 B2
(45) Date of Patent: Mar. 13, 2018

(54) LUBRICANT COMPOSITION WITH PHOSPHORUS-FUNCTIONALIZED POLYMERS

(75) Inventors: Boris Eisenberg, Heppenheim (DE); Ellen Suchert, Bensheim (DE)

(73) Assignee: Evonik Oil Additives GmbH, Darmstadt (DE)

( * ) Notice: Subject to any disclaimer, the term of this patent is extended or adjusted under 35 U.S.C. 154(b) by 873 days.

(21) Appl. No.: 14/119,550

(22) PCT Filed: Apr. 19, 2012

(86) PCT No.: PCT/EP2012/057166

§ 371 (c)(1),
(2), (4) Date: Nov. 22, 2013

(87) PCT Pub. No.: WO2012/159828

PCT Pub. Date: Nov. 29, 2012

(65) Prior Publication Data

US 2014/0135242 A1 May 15, 2014

(30) Foreign Application Priority Data

May 24, 2011 (DE) ..... 10 2011 076 364

(51) Int. Cl.
*C10M 137/10* (2006.01)
*C08F 24/00* (2006.01)
(Continued)

(52) U.S. Cl.
CPC .. *C10M 153/02* (2013.01); *C10M 2203/1006* (2013.01); *C10M 2203/1025* (2013.01);
(Continued)

(58) Field of Classification Search
CPC ..... C10M 2223/04; C08F 220/32
(Continued)

(56) References Cited

U.S. PATENT DOCUMENTS 3,281,500 A * 10/1966 Bauer ..... C08F 291/00 508/426
3,342,734 A 9/1967 Bauer
(Continued)

FOREIGN PATENT DOCUMENTS

DE 10 2007 036 856 2/2009
DE 10 2010 028 195 10/2011
(Continued)

OTHER PUBLICATIONS

Japanese Office Action dated Oct. 13, 2015 in Patent Application No. 2014-511796 (English Translation Only).
(Continued)

*Primary Examiner* — Vishal Vasisth
(74) *Attorney, Agent, or Firm* — Oblon, McClelland, Maier & Neustadt, L.L.P.

(57) ABSTRACT

The present invention relates to a lubricant composition comprising at least one polyalkyl(meth)acrylate including repeating units derived from (meth)acrylates having 6 to 22 carbon atoms in the alcohol radical, wherein the polyalkyl (meth)acrylate includes repeating units derived from ethylenically unsaturated monomers having at least one covalently bonded phosphorus atom. The present invention further relates to a polyalkyl(meth)acrylate suitable for such a lubricant composition and to the use of a polyalkyl(meth) acrylate having repeating units derived from ethylenically unsaturated monomers having at least one covalently bonded phosphorus atom for reducing friction.

9 Claims, 2 Drawing Sheets

Results of the VKA wear test

(51) Int. Cl.
*C08F 124/00* (2006.01)
*C08F 224/00* (2006.01)
*C10M 153/02* (2006.01)

(52) U.S. Cl.
CPC ..... *C10M 2205/0285* (2013.01); *C10M 2209/084* (2013.01); *C10M 2223/04* (2013.01); *C10M 2223/045* (2013.01); *C10M 2223/047* (2013.01); *C10M 2223/049* (2013.01); *C10M 2223/06* (2013.01); *C10M 2225/02* (2013.01); *C10N 2220/021* (2013.01); *C10N 2230/06* (2013.01); *C10N 2230/08* (2013.01); *C10N 2240/04* (2013.01); *C10N 2240/10* (2013.01)

(58) Field of Classification Search
USPC ..... 508/426; 526/273
See application file for complete search history.

(56) References Cited

U.S. PATENT DOCUMENTS

| | | | |
|---|---|---|---|
| 2011/0237473 | A1 | 9/2011 | Stoehr et al. |
| 2013/0229016 | A1 | 9/2013 | Ghahary et al. |

FOREIGN PATENT DOCUMENTS

| | | | |
|---|---|---|---|
| EP | 0 319 971 | | 6/1989 |
| GB | 903 701 | | 8/1962 |
| JP | 59 160152 | | 9/1984 |
| JP | 2004-169022 | A | 6/2004 |
| JP | 2008-31459 | A | 2/2008 |
| JP | 2009-149874 | A | 7/2009 |
| JP | 2009-173921 | A | 8/2009 |

OTHER PUBLICATIONS

Written Opinion dated Jan. 22, 2015 in Singaporean Patent Application No. 2013081971.

Keromest, C. et al., "Synthese, Caracterisation et Application Aux Huiles Lubrifiantes D' Additifs Polymers Phosphosoufres Ameliorants DV VI, Antiusure et Extreme Pression", Oil & Gas Science & Technology, vol. 52, No. 1, pp. 35-44, XP000684835, (Jan. 1, 1997) (with partial English translation).

German Search Report dated Nov. 16, 2011, in German Patent Application No. 10 2011 076 364.3 Filed May 24, 2011(with English translation).

International Search Report dated Jun. 6, 2012 in PCT/EP12/057166 Filed Apr. 19, 2012.

Kai Zhang, "6-3-3 Several factors influencing the fluidity of polymer melts" Polymer Physics, Press of University of Science and Technology of Chengdu, 1981, 6 pages (with English language translation).

* cited by examiner

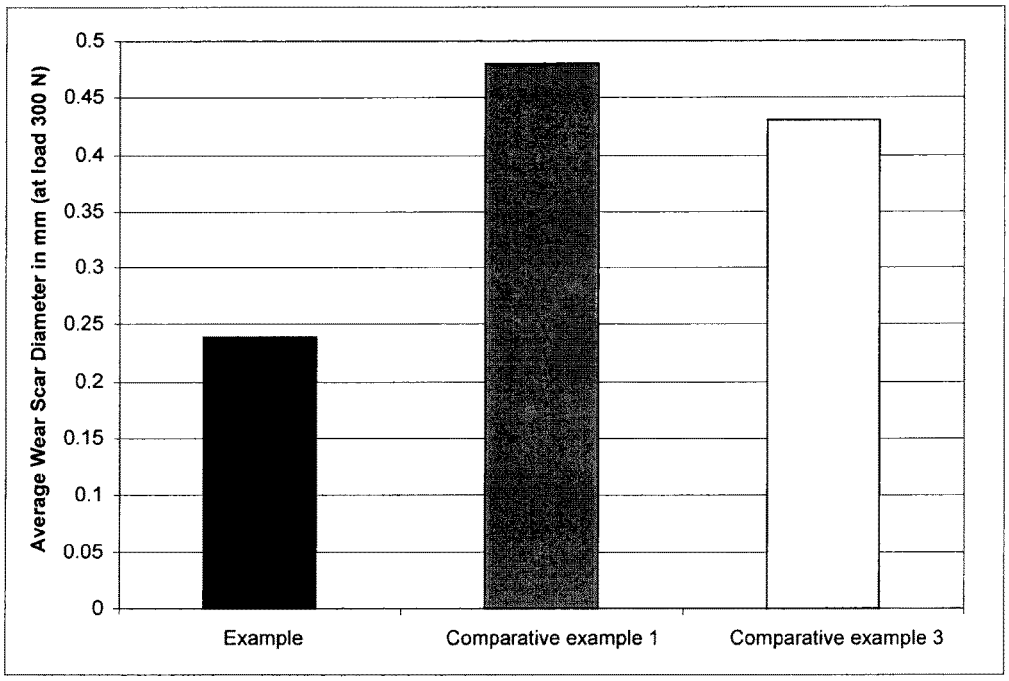
Figure 1: Results of the VKA wear test

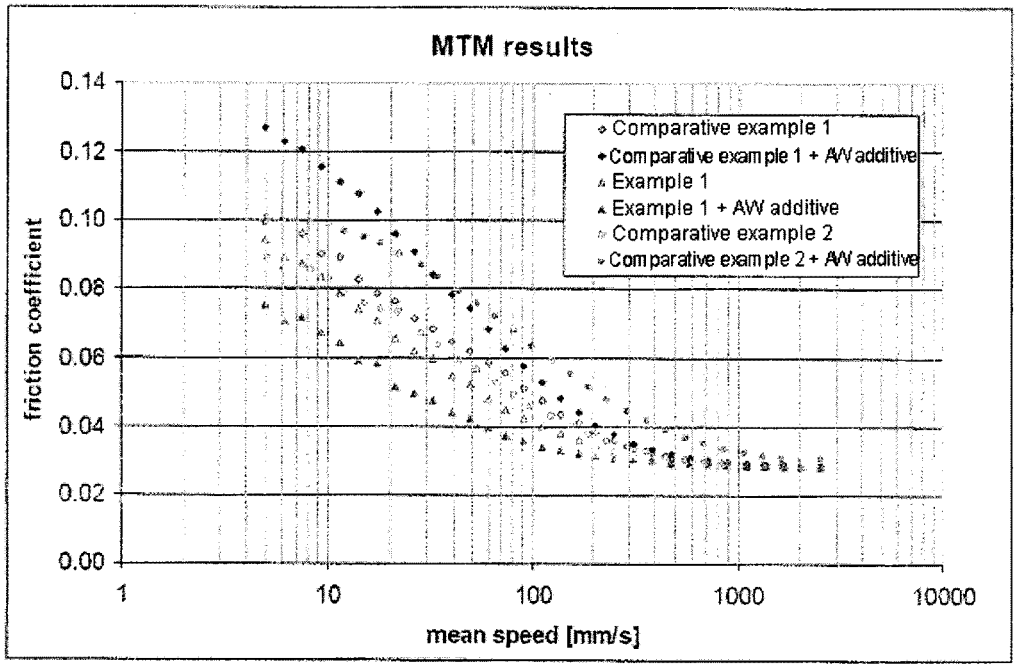
Figure 2: Results of the MTM test

LUBRICANT COMPOSITION WITH PHOSPHORUS-FUNCTIONALIZED POLYMERS

This application is a 371 of PCT/EP12/57166, filed Apr. 19, 2012.

The present invention relates to a lubricant composition comprising phosphate-functionalized polymers, to phosphate-functionalized polyalkyl(meth)acrylates, and to the use of a polyalkyl(meth)acrylate for reducing friction.

The wear-reducing effect of low molecular weight (thio) phosphate esters in lubricants is known. Thus, these are used as standard in antiwear packages. These additives are activated by increasing the temperature or by plastic deformation (pressure) and form a separating and lubricating layer on the metal surface.

Publication U.S. Pat. No. 3,484,504 describes reaction products formed from a basic, nitrogen-containing polymer and a (thio)phosphoric partial ester, and the use thereof as a lubricant oil additive. Examples of the nitrogen-containing monomer are, for example, N,N-dimethylaminoethyl (meth) acrylate or morpholinoethyl (meth)acrylate. Further comonomers may include $C_2$-$C_{18}$ acrylates or methacrylates, styrene monomers, vinyl esters, allyl esters and vinyl ethers.

Publications DE 69431710 A and EP 0 686 690 A describe lubricant compositions for transmission systems with improved sludge dispersion properties. Improved sludge dispersion is achieved by the interaction of a phosphorus compound (e.g. phosphate ester, phosphonate ester) and a nitrogen-containing oil-soluble copolymer. The nitrogen-containing monomer here is, for example, N,N-dialkylaminoalkyl (meth)acrylate. Listed as comonomers are $C_1$-$C_{24}$ acrylates or methacrylates.

Publications WO 2003/089554 and U.S. Pat. No. 6,586,375 describe lubricant compositions comprising a salt of a nitrogen-containing poly(meth)acrylate and a phosphoric partial ester. Here, the improved effects in terms of dispersion capacity, VI action and wear-reducing properties are claimed in lubricant oil compositions for engines and transmission systems. The nitrogen-containing monomers used here were N-vinylpyrrolidone and N,N-dimethylaminopropylmethacrylamide. Comonomers here include $C_1$-$C_{30}$ acrylates or methacrylates.

Document US 2006/0135380 describes a method for lubricating a transmission system with the aim of imparting fatigue control. The compositions used here are those from WO 2003/089554 and U.S. Pat. No. 6,586,375.

It is thus known from the prior art that the use of salts of phosphoric partial esters and a nitrogen-containing polymer leads to improved effects in sludge dispersion (DE 69431710, EP 0686690) and in the antiwear properties, the dispersion characteristics and viscosity-temperature characteristics of engines and transmission oils (WO 2003/089554, U.S. Pat. No. 6,586,375).

The above-detailed lubricant compositions already lead to a useful profile of properties. However, there is a constant need to improve this profile of properties.

In view of the prior art, it is thus an object of the present invention to provide lubricant compositions which go beyond the state of the art.

More particularly, lubricant compositions are to have high wear protection, while simultaneously providing excellent friction characteristics.

Furthermore, it is an object of the present invention to provide polymers with wear-reducing action for a lubricant composition, these being usable in relatively large volumes in industrial hydraulic oils without this causing any high degree of adverse effects.

Moreover, the lubricant compositions are to have elevated hydrolysis stability in order to provide an extended temperature range for the use of lubricant compositions under stable conditions.

It was a further object of the invention to provide lubricant compositions and friction value-reducing polymers as additives, which can be produced in a simple and inexpensive manner, and the components used should especially be commercially available. At the same time, production should be possible on the industrial scale without any requirement for new plants, or plants of complex construction, for this purpose.

Furthermore, the additive should lead to an improvement in fuel consumption, but this should not impair the environmental compatibility of the lubricant composition.

These objects, and further objects which are not stated explicitly but can immediately be derived or discerned from the connections discussed herein by way of introduction, are achieved by a lubricant composition according to the claims.

BRIEF DESCRIPTION OF THE DRAWINGS

FIG. 1 is a graph illustrating results of a VKA wear test.

FIG. 2 is a graph illustrating results of an MTM test.

The present invention accordingly provides a lubricant composition comprising at least one polyalkyl(meth)acrylate including repeating units derived from (meth)acrylates having 6 to 22 carbon atoms in the alcohol radical, which is characterized in that the polyalkyl(meth)acrylate includes repeating units derived from ethylenically unsaturated monomers having at least one covalently bonded phosphorus atom.

It is thus possible in an unforeseeable manner to provide a lubricant composition having an improved profile of properties.

The inventive lubricant composition can achieve the following advantages among others:

More particularly, the lubricant compositions usable in accordance with the invention surprisingly exhibit improved wear protection, coupled with simultaneously excellent friction characteristics. In particular configurations of the present invention, friction characteristics can be enhanced together with wear protection. This is particularly astonishing since the addition of an additive for wear reduction typically results in a simultaneous deterioration in the friction value.

It is surprisingly possible through the inventive lubricant compositions to achieve increased hydrolysis stability and thermal stability compared to the prior art lubricant compositions comprising salts of phosphoric partial esters and a nitrogen-containing polymer.

A further advantage here is that the wear-reducing properties and viscosity index-improving action of the polyalkyl (meth)acrylate (PAMA) used in accordance with the invention, including repeating units having at least one covalently bonded phosphorus atom, are combined in one component.

This covalent bond achieves improved hydrolysis stability of the lubricant composition, especially at thermal hotspots, which leads to improved wear protection over time.

In addition, polymers having wear-reducing action for a lubricant composition are provided, and these do not exhibit dispersibility but instead are demulsifiable (water-separating), such that they can be used in relatively large volumes in industrial hydraulic oils.

Furthermore, the present invention provides lubricant compositions which can be produced in a simple and inexpensive manner, and it is especially possible to use commercially available components. At the same time, production can be effected on the industrial scale, without new plants or plants of complex construction being required for this purpose.

Moreover, the lubricant composition can lead to an improvement in fuel consumption, and no adverse effects are associated with environmental compatibility thereby.

The present invention relates to a lubricant composition. Lubricant compositions, especially lubricant oils, serve to reduce friction and wear, and to transmit forces, for cooling, for vibration damping, for sealing action and for corrosion protection. In this context, transmission oils are typically distinguished from other lubricant oils which may serve, for example, for lubrication of engines. Typically, these differences are manifested particularly in the additives added, and transmission oils compared to motor oils in many cases have higher proportions of antiwear and extreme pressure additives. In a particular aspect of the present invention, the lubricant composition can be used as a hydraulic oil.

The inventive lubricant composition comprises at least one polyalkyl(meth)acrylate comprising repeating units derived from (meth)acrylates having 6 to 22 carbon atoms in the alcohol radical, the polyalkyl(meth)acrylate including repeating units derived from ethylenically unsaturated monomers having at least one covalently bonded phosphorus atom.

Polyalkyl(meth)acrylates are polymers obtainable by the polymerization of alkyl (meth)acrylates. The expression "(meth)acrylates" includes methacrylates and acrylates, and mixtures of the two. These monomers are widely known.

Polyalkyl(meth)acrylates include preferably at least 40% by weight, more preferably at least 60% by weight, especially preferably at least 80% by weight and most preferably at least 90% by weight of repeating units derived from alkyl (meth)acrylates.

In a particular aspect of the present invention, preference is given to polyalkyl(meth)acrylates including preferably at least 20% by weight, more preferably at least 40% by weight, especially preferably at least 60% by weight and most preferably at least 80% by weight of repeating units derived from alkyl (meth)acrylates having 6 to 22 carbon atoms in the alcohol radical.

Of particular interest, among others, are polyalkyl(meth) acrylates including repeating units derived from (meth) acrylates having 6 to 22 carbon atoms in the alcohol radical, and repeating units derived from ethylenically unsaturated monomers having at least one covalently bonded phosphorus atom, preferably a weight-average molecular weight $M_w$ in the range from 5000 to 10 000 000 g/mol, preferably 10 000 to 600 000 g/mol and most preferably 15 000 to 80 000.

The number-average molecular weight $M_n$ may preferably be in the range from 1000 to 500 000 g/mol, more preferably 7500 to 500 000 g/mol and most preferably 10 000 to 80 000 g/mol.

Additionally appropriate are polyalkyl(meth)acrylates whose polydispersity index $M_w/M_n$ is in the range from 1.1 to 5.0, more preferably in the range from 1.4 to 4.5 and most preferably in the range from 1.6 to 3.0.

The number-average and weight-average molecular weight can be determined by known processes, for example gel permeation chromatography (GPC), preferably using a PMMA standard. The molecular weight of the polymer can preferably be determined before the derivatization thereof with a phosphorus compound.

Preferred polyalkyl(meth)acrylates include a) includes 0 to 40% by weight, especially 1 to 25% by weight and more preferably 2 to 15% by weight of repeating units derived from (meth)acrylates of the formula (I)

(I)

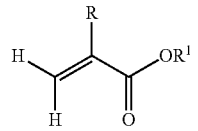

in which R is hydrogen or methyl and $R^1$ is an alkyl radical having 1 to 5 carbon atoms, b) includes 20 to 99.9% by weight, preferably 50 to 99.9% by weight, especially at least 70% by weight and more preferably at least 80% by weight of repeating units derived from (meth)acrylates of the formula (II)

(II)

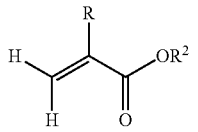

in which R is hydrogen or methyl and $R^2$ is an alkyl radical having 6 to 22 carbon atoms, c) includes 0 to 20% by weight, preferably 0.1 to 20% by weight, more preferably 0.5 to 15% by weight and especially preferably 1 to 10% by weight of repeating units derived from (meth)acrylates of the formula (III)

(III)

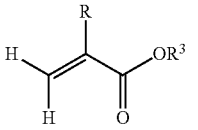

in which R is hydrogen or methyl and $R^3$ is an alkyl radical having 23 to 4000 carbon atoms, and d) 0.1 to 22% by weight, preferably 1 to 18% by weight, more preferably 2 to 15% by weight and especially preferably 4 to 12 weight of repeating units derived from ethylenically unsaturated monomers having at least one covalently bonded phosphorus atom.

The polyalkyl(meth)acrylates can preferably be obtained by free-radical polymerization. Accordingly, the proportion by weight of the respective repeating units that these polymers contain results from the proportions by weight of corresponding monomers used to prepare the polymers.

Examples of (meth)acrylates of the formula (I) include linear and branched (meth)acrylates which derive from saturated alcohols, such as methyl (meth)acrylate, ethyl (meth)acrylate, n-propyl (meth)acrylate, isopropyl (meth) acrylate, n-butyl (meth)acrylate, tert-butyl (meth)acrylate and pentyl (meth)acrylate; and cycloalkyl (meth)acrylates such as cyclopentyl (meth)acrylate.

The (meth)acrylates of the formula (II) include especially linear and branched (meth)acrylates which derive from saturated alcohols, such as hexyl (meth)acrylate, 2-ethylhexyl (meth)acrylate, heptyl (meth)acrylate, 2-tert-butylheptyl (meth)acrylate, octyl (meth)acrylate, 3-isopropylheptyl (meth)acrylate, nonyl (meth)acrylate, decyl (meth) acrylate, undecyl (meth)acrylate, 5-methylundecyl (meth) acrylate, dodecyl (meth)acrylate, 2-methyldodecyl (meth) acrylate, tridecyl (meth)acrylate, 5-methyl-tridecyl (meth) acrylate, tetradecyl (meth)acrylate, pentadecyl (meth) acrylate, hexadecyl (meth)acrylate, 2-methylhexadecyl (meth)acrylate, 2-methylpentadecyl (meth)acrylate, 2-ethyltetradecyl (meth)acrylate, 2-propyltridecyl (meth)acrylate, 2-butyldodecyl (meth)acrylate, 2-methylhexadecyl (meth) acrylate, 2-pentyldodecyl (meth)acrylate, 2-hexyldecyl (meth)acrylate, 2-hexylundecyl (meth)acrylate, n-heptadecyl (meth)acrylate, 5-isopropylheptadecyl (meth)acrylate, 4-tert-butyl-octadecyl (meth)acrylate, 5-ethyloctadecyl (meth)acrylate, 3-isopropyloctadecyl (meth)acrylate, octadecyl (meth)acrylate, nonadecyl (meth)acrylate, eicosyl (meth)acrylate, docosyl (meth)acrylate;

(meth)acrylates which derive from unsaturated alcohols, for example oleyl (meth)acrylate; and cycloalkyl (meth)acrylates such as cyclohexyl (meth)acrylate, 3-vinylcyclohexyl (meth)acrylate, bornyl (meth)acrylate, 2,4,5-tri-t-butyl-3-vinylcyclohexyl (meth)acrylate, 2,3,4,5-tetra-t-butylcyclohexyl (meth)acrylate.

Examples of monomers of the formula (III) include linear and branched (meth)acrylates which derive from saturated alcohols, such as cetyleicosyl (meth)acrylate, stearyleicosyl (meth)acrylate and/or eicosyltetratriacontyl (meth)acrylate; cycloalkyl (meth)acrylates such as 2,3,4,5-tetra-t-hexylcyclohexyl (meth)acrylate.

In a particular configuration of the present invention, the monomers of the formula (III) include what are called polyolefin-based macromonomers with (meth)acrylate groups, which are described inter alia in DE 10 2007 032 120 A1, filed Jul. 9, 2007 at the German Patent Office with application number DE102007032120.3; and DE 10 2007 046 223 A1, filed Sep. 26, 2007 at the German Patent Office with application number DE 102007046223.0; the disclosures of these publications, more particularly the (meth) acrylates having at least 23 carbon atoms in the radical described therein, are incorporated into the present application by reference for the purposes of disclosure.

Polyolefin-based macromonomers are known in the specialist field. These repeating units include at least one group derived from polyolefins. Polyolefins are known in the specialist field, these being obtainable by polymerization of alkenes and/or alkadienes consisting of the elements carbon and hydrogen, for example $C_2$-$C_{10}$-alkenes such as ethylene, propylene, n-butene, isobutene, norbornene, and/or $C_4$-$C_{10}$-alkadienes such as butadiene, isoprene, norbornadiene. The repeating units derived from polyolefin-based macromonomers include preferably at least 70% by weight and more preferably at least 80% by weight and most preferably at least 90% by weight of groups derived from alkenes and/or alkadienes, based on the weight of the repeating units derived from polyolefin-based macromonomers. In this case, the polyolefinic groups may especially also be present in hydrogenated form. As well as the groups derived from alkenes and/or alkadienes, the repeating units derived from polyolefin-based macromonomers may include further groups. These include small proportions of copolymerizable monomers. These monomers are known per se and include alkyl (meth)acrylates, styrene monomers, fumarates, maleates, vinyl esters and/or vinyl ethers. The proportion of these groups based on copolymerizable monomers is preferably at most 30% by weight, more preferably at most 15% by weight, based on the weight of the repeating units derived from polyolefin-based macromonomers. In addition, the repeating units derived from polyolefin-based macromonomers may include starting groups and/or end groups which serve for functionalization or result from the preparation of the repeating units derived from polyolefin-based macromonomers. The proportion of these starting groups and/or end groups is preferably at most 30% by weight, more preferably at most 15% by weight, based on the weight of the repeating units derived from polyolefin-based macromonomers.

The number-average molecular weight of the repeating units derived from polyolefin-based macromonomers is preferably in the range from 500 to 50 000 g/mol, more preferably 700 to 10 000 g/mol, especially 1500 to 4900 g/mol and most preferably 2000 to 3000 g/mol.

In the case of preparation of the comb polymers by copolymerization of low molecular weight and macromolecular monomers, these values result from the properties of the macromolecular monomers. In the case of polymer-analogous reactions, this property arises, for example, from the macroalcohols and/or macroamines used, taking account of the converted repeating units in the main chain. In the case of graft copolymerizations, the molecular weight distribution of the polyolefin can be concluded via the proportion of polyolefins formed which has not been incorporated into the main chain.

The repeating units derived from polyolefin-based macromonomers preferably have a low melting temperature, this being measured by means of DSC. The melting temperature of the repeating units derived from the polyolefin-based macromonomers is preferably less than or equal to −10° C., especially preferably less than or equal to −20° C., more preferably less than or equal to −40° C. Most preferably, no melting temperature can be measured by DSC for the repeating units derived from the polyolefin-based macromonomers.

In addition, the monomers of the formula (III) include especially long-chain branched (meth)acrylates, which are described, inter alia, in U.S. Pat. No. 6,746,993, filed Aug. 7, 2002 at the US Patent Office (USPTO) with application Ser. No. 10/212,784; and US 2004/077509, filed Aug. 1, 2003 at the US Patent Office (USPTO) with application Ser. No. 10/632,108; the disclosures of these publications, especially the (meth)acrylates having at least 23 carbon atoms in the radical described therein, are incorporated into the present application by reference for the purposes of disclosure.

Alkyl (meth)acrylates with a long-chain alcohol radical, especially components (II) and (III), can be obtained, for example, by reaction of (meth)acrylates and/or the corresponding acids with long-chain fatty alcohols, which generally gives rise to a mixture of esters, for example (meth) acrylates with various long-chain alcohol radicals. These fatty alcohols include Oxo Alcohol® 7911, Oxo Alcohol® 7900, Oxo Alcohol® 1100; Alfol® 610, Alfol® 810, Lial® 125 and Nafol® products (Sasol); C13-C15-Alkohol (BASF); Epal® 610 and Epal® 810 (Afton); Linevol® 79, Linevol® 911 and Neodol® 25 (Shell); Dehydad®, Hydrenol® and Lorol® products (Cognis); Acropol® 35 and Exxal® 10 (Exxon Chemicals); Kalcol® 2465 (Kao Chemicals).

The polyalkyl(meth)acrylate includes repeating units derived from ethylenically unsaturated monomers having at least one covalently bonded phosphorus atom.

In a preferred embodiment of the invention, the polyalkyl (meth)acrylate for use in accordance with the invention having repeating units derived from ethylenically unsaturated monomers having at least one covalently bonded phosphorus atom may include preferably 0.05 to 1.5% by weight, more preferably 0.2 to 0.9% by weight and especially preferably 0.3 to 0.8% by weight of phosphorus atoms, based on the weight of the polyalkyl(meth)acrylate. These polyalkyl(meth)acrylates including repeating units derived from (meth)acrylates having 6 to 22 carbon atoms in the alcohol radical are novel and thus likewise form part of the subject matter of this invention.

Ethylenically unsaturated monomers having at least one covalently bonded phosphorus atom, from which the repeating units of the polyalkyl(meth)acrylate are derived, are known per se. These include 2-(dimethylphosphato)propyl (meth)acrylate,
2-(ethylenephosphito)propyl (meth)acrylate,
dimethylphosphinomethyl (meth)acrylate,
dimethylphosphonoethyl (meth)acrylate,
diethyl(meth)acryloyl phosphonate,
dipropyl(meth)acryloyl phosphate,
2-(dibutylphosphono)ethyl (meth)acrylate, and
diethylphosphatoethyl (meth)acrylate.

In this context, the polyalkyl(meth)acrylate of this preferred embodiment of the invention may include repeating units derived from phosphorus derivatives of a polar ethylenically unsaturated monomer.

The expression "polar ethylenically unsaturated monomer" makes it clear that the monomer can be free-radically polymerized. In addition, the term "polar" expresses the fact that the monomer, even after the reaction with a phosphorus derivative, is particularly polar in the environment of the reaction site. The groups involved here especially include hydroxyl groups which form, and are obtained in the reaction of epoxides.

Moreover, the polar ethylenically unsaturated monomer from which the phosphorus derivative is derived may be a (meth)acrylate having an epoxide group.

The phosphorus derivatives of a polar ethylenically unsaturated monomer include 2-(dimethylphosphato)-3-hydroxypropyl (meth)acrylate,
2-(ethylenephosphito)-3-hydroxypropyl (meth)acrylate,
3-(meth)acryloyloxy-2-hydroxypropyl diethyl phosphonate,
3-(meth)acryloyloxy-2-hydroxypropyl dipropyl phosphonate,
3-(dimethylphosphato)-2-hydroxypropyl (meth)acrylate,
3-(ethylenephosphito)-2-hydroxypropyl (meth)acrylate,
2-(meth)acryloyloxy-3-hydroxypropyl diethyl phosphonate,
2-(meth)acryloyloxy-3-hydroxypropyl dipropyl phosphonate,
2-(dibutylphosphono)-3-hydroxypropyl (meth)acrylate, and
diethylphosphatoethyl (meth)acrylate.

In addition, the monomer mixture for preparation of the polyalkyl(meth)acrylates for use in accordance with the invention may comprise monomers copolymerizable with the monomers detailed above. These include aryl (meth) acrylates such as benzyl methacrylate or phenyl methacrylate, where the aryl radicals may in each case be unsubstituted or up to tetrasubstituted;

styrene monomers, for example styrene, substituted styrenes having an alkyl substituent in the side chain, substituted styrenes having an alkyl substituent on the ring, such as vinyltoluene and p-methylstyrene, halogenated styrenes, for example monochlorostyrenes, dichlorostyrenes, tribromostyrenes and tetrabromostyrenes;

itaconic acid and itaconic acid derivatives, for example itaconic monoesters, itaconic diesters and itaconic anhydride;

fumaric acid and fumaric acid derivatives, for example fumaric monoesters, fumaric diesters and fumaric anhydride;

vinyl and isoprenyl ethers, for example alkyl vinyl ethers, especially methyl vinyl ether, ethyl vinyl ether and dodecyl vinyl ether;

vinyl esters, for example vinyl acetate;

1-alkenes, especially 1-butene, 1-pentene, 1-hexene, 1-heptene, 1-octene, 1-nonene, 1-decene, 1-undecene, 1-dodecene, 1-tridecene, 1-tetradecene and 1-pentadecene.

In a particular embodiment, it is especially possible to use dispersing monomers.

Dispersing monomers have long been used for functionalization of polymeric additives in lubricant oils and are therefore known to those skilled in the art (cf. R. M. Mortier, S. T. Orszulik (eds.): "Chemistry and Technology of Lubricants", Blackie Academic & Professional, London, 2nd ed. 1997). It is appropriately possible to use particularly heterocyclic vinyl compounds and/or ethylenically unsaturated, polar ester or amide compounds of the formula (IV)

(IV)

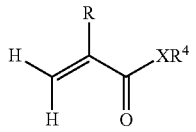

in which R is hydrogen or methyl, X is oxygen, sulfur or an amino group of the formula —NH— or —$NR^a$—, in which $R^a$ is an alkyl radical having 1 to 10 and preferably 1 to 4 carbon atoms, $R^4$ is a radical which comprises 2 to 50, especially 2 to 30 and preferably 2 to 20 carbon atoms and has at least one heteroatom, preferably at least two heteroatoms, as dispersing monomers.

Examples of dispersing monomers of the formula (IV) include aminoalkyl (meth)acrylates, aminoalkyl (meth)acrylamides, hydroxyalkyl (meth)acrylates, heterocyclic (meth) acrylates and/or carbonyl-containing (meth)acrylates.

The hydroxyalkyl (meth)acrylates include 2-hydroxypropyl (meth)acrylate,
3,4-dihydroxybutyl (meth)acrylate,
2-hydroxyethyl (meth)acrylate,
3-hydroxypropyl (meth)acrylate,
2,5-dimethyl-1,6-hexanediol (meth)acrylate and
1,10-decanediol (meth)acrylate.

Carbonyl-containing (meth)acrylates comprise, for example, 2-carboxyethyl (meth)acrylate,
carboxymethyl (meth)acrylate,
N-(methacryloyloxy)formamide,
acetonyl (meth)acrylate,
mono-2-(meth)acryloyloxyethyl succinate,
N-(meth)acryloylmorpholine,
N-(meth)acryloyl-2-pyrrolidinone,
N-(2-(meth)acryloyloxyethyl)-2-pyrrolidinone,
N-(3-(meth)acryloyloxypropyl)-2-pyrrolidinone,
N-(2-(meth)acryloyloxypentadecyl)-2-pyrrolidinone,
2-acetoacetoxyethyl (meth)acrylate,
N-(3-(meth)acryloyloxyheptadecyl)-2-pyrrolidinone and
N-(2-(meth)acryloyloxyethyl)ethyleneurea.

The heterocyclic (meth)acrylates include 2-(1-imidazolyl)ethyl (meth)acrylate,
oxazolidinylethyl (meth)acrylate,
2-(4-morpholinyl)ethyl (meth)acrylate,
1-(2-methacryloyloxyethyl)-2-pyrrolidone, N-methacryloylmorpholine,
N-methacryloyl-2-pyrrolidinone,
N-(2-methacryloyloxyethyl)-2-pyrrolidinone,
N-(3-methacryloyloxypropyl)-2-pyrrolidinone.

The aminoalkyl (meth)acrylates include especially
N,N-dimethylaminoethyl (meth)acrylate,
N,N-dimethylaminopropyl (meth)acrylate,
N,N-diethylaminopentyl (meth)acrylate,
N,N-dibutylaminohexadecyl (meth)acrylate.

In addition, it is possible to use aminoalkyl (meth)acrylamides as dispersing monomers, such as N,N-dimethylaminopropyl(meth)acrylamide.

The preferred heterocyclic vinyl compounds include 2-vinylpyridine, 3-vinylpyridine, 4-vinylpyridine, 2-methyl-5-vinylpyridine, 3-ethyl-4-vinylpyridine, 2,3-dimethyl-5-vinylpyridine, vinylpyrimidine, vinylpiperidine, 9-vinylcarbazole, 3-vinylcarbazole, 4-vinylcarbazole, 1-vinylimidazole, N-vinylimidazole, 2-methyl-1-vinylimidazole, N-vinylpyrrolidone, N-vinylpyrrolidine, 3-vinylpyrrolidine, N-vinylcaprolactam, N-vinylbutyrolactam, vinyloxolane, vinylfuran, vinylthiophene, vinylthiolane, vinylthiazoles and hydrogenated vinylthiazoles, vinyloxazoles and hydrogenated vinyloxazoles.

The particularly preferred dispersing monomers include especially ethylenically unsaturated compounds comprising at least one nitrogen atom, these being selected with particular preference from the above-detailed heterocyclic vinyl compounds and/or aminoalkyl (meth)acrylates, aminoalkyl (meth)acrylamides and/or heterocyclic (meth)acrylates.

The proportion of comonomers can be varied according to the end use and profile of properties of the polymer. In general, this proportion may be in the range from 0 to 30% by weight, preferably 0.01 to 20% by weight and more preferably 0.1 to 10% by weight.

The aforementioned ethylenically unsaturated monomers can be used individually or as mixtures. It is additionally possible to vary the monomer composition during the polymerization of the main chain in order to obtain defined structures, for example block copolymers or graft polymers. In a particular aspect of the present invention, the present polyalkyl(meth)acrylates are configured as random copolymers in which the distribution of the two monomers in the chain is random. This can achieve surprising advantages which are manifested particularly in better rheology values.

The preparation of the polyalkyl(meth)acrylates from the above-described compositions is known per se. For instance, these polymers can be obtained especially by free-radical polymerization, and also related processes, for example ATRP (=Atom Transfer Radical Polymerization), RAFT (=Reversible Addition Fragmentation Chain Transfer) or NMP (=Nitroxide-Mediated Polymerization) processes.

The ATRP process is known per se. This reaction regime is described, for example, by J.-S. Wang, et al., J. Am. Chem. Soc., vol. 117, p. 5614-5615 (1995), by Matyjaszewski, Macromolecules, vol. 28, p. 7901-7910 (1995). In addition, patent applications WO 96/30421, WO 97/47661, WO 97/18247, WO 98/40415 and WO 99/10387 disclose variants of the above-described ATRP.

In addition, the inventive polymers can be obtained, for example, via RAFT methods too. This method is explained in detail, for example, in WO 98/01478 and WO 2004/083169, to which explicit reference is made for the purposes of the disclosure.

In addition, the inventive polymers are obtainable by NMP processes (nitroxide-mediated polymerization), which are described in U.S. Pat. No. 4,581,429 inter alia.

One comprehensive description, more particularly with further references, of these methods is given in K. Matyjaszewski, T. P. Davis, Handbook of Radical Polymerization, Wiley Interscience, Hoboken 2002, to which explicit reference is made for the purposes of disclosure.

The free-radical polymerization of the ethylenically unsaturated compounds can be effected in a manner known per se. Customary free-radical polymerization is described inter alia in Ullmann's Encyclopedia of Industrial Chemistry, Sixth Edition.

In the context of the present invention, the polymerization is initiated using at least one polymerization initiator for free-radical polymerization. These include the azo initiators widely known in the specialist field, such as 2,2'-azobisisobutyronitrile, 2,2'-azobis(2,4-dimethylvaleronitrile) and 1,1-azobiscyclohexanecarbonitrile, organic peroxides such as dicumyl peroxide, diacyl peroxides such as dilauroyl peroxide, peroxydicarbonates such as diisopropyl peroxydicarbonate, peresters such as tert-butyl peroxy-2-ethylhexanoate, and the like.

Polymerization initiators of very particular suitability for the purposes of the present invention include especially the following compounds:
methyl ethyl ketone peroxide, acetylacetone peroxide, dilauroyl peroxide, tert-butyl per-2-ethylhexanoate, ketone peroxide, tert-butyl peroctoate, methyl isobutyl ketone peroxide, cyclohexanone peroxide, dibenzoyl peroxide, tert-butyl peroxybenzoate, tert-butyl peroxyisopropylcarbonate, 2,5-bis(2-ethylhexanoylperoxy)-2,5-dimethyl-hexane, tert-butyl peroxy-2-ethylhexanoate, tert-butyl peroxy-3,5,5-trimethylhexanoate, dicumyl peroxide, 1,1-bis(tert-butylperoxy)cyclohexane, 1,1-bis(tert-butylperoxy)-3,3,5-trimethylcyclohexane, cumyl hydroperoxide, tert-butyl hydroperoxide, bis(4-tert-butylcyclohexyl) peroxydicarbonate, 2,2'-azobisisobutyronitrile, 2,2'-azobis(2,4-dimethylvaleronitrile), 1,1-azobiscyclohexanecarbonitrile, diisopropylperoxydicarbonate, tert-amyl peroxypivalate, di(2,4-dichlorobenzoyl) peroxide, tert-butyl peroxypivalate, 2,2'-azobis(2-amidinopropane)dihydrochloride, di(3,5,5-trimethylhexanoyl) peroxide, dioctanoyl peroxide, didecanoyl peroxide, 2,2'-azobis(N,N'-dimethyleneisobutyramidine), di(2-methylbenzoyl) peroxide, dimethyl 2,2'-azobisisobutyrate, 2,2'-azobis(2-methylbutyronitrile), 2,5-dimethyl-2,5-di(2-ethylhexanoylperoxy)hexane, 4,4'-azobis(cyanopentanoic acid), di(4-methylbenzoyl) peroxide, dibenzoyl peroxide, tert-amyl peroxy-2-ethylhexanoate, tert-butyl peroxy-2-ethylhexanoate, tert-butyl peroxyisobutyrate and mixtures of the aforementioned polymerization initiators.

According to the invention, very particular preference is given to polymerization initiators having a half-life of 1 hour at a temperature in the range from 25° C. to 200° C., preferably in the range from 50° C. to 150° C., especially in the range from 50° C. to 100° C. In addition, peroxidic polymerization initiators, especially tert-butyl peroctoate, are very particularly suitable for the present purposes.

The process can be performed either in the presence or in the absence of a chain transferer. The chain transferers, also called molecular weight regulators, used may be typical species described for free-radical polymerizations, as known to those skilled in the art.

The sulfur-free molecular weight regulators include, for example, without any intention that this should impose a restriction, dimeric α-methylstyrene (2,4-diphenyl-4-methyl-1-pentene), enol ethers of aliphatic and/or cycloaliphatic aldehydes, terpenes, β-terpinene, terpinolene, 1,4-cyclohexadiene, 1,4-dihydronaphthalene, 1,4,5,8-tetrahydronaphthalene, 2,5-dihydrofuran, 2,5-dimethylfuran and/or 3,6-di-hydro-2H-pyran, preference being given to dimeric α-methylstyrene.

The sulfur-containing molecular weight regulators used may preferably be mercapto compounds, dialkyl sulfides, dialkyl disulfides and/or diaryl sulfides. The following polymerization regulators are mentioned by way of example: di-n-butyl sulfide, di-n-octyl sulfide, diphenyl sulfide, thiodiglycol, ethylthioethanol, diisopropyl disulfide, di-n-butyl disulfide, di-n-hexyl disulfide, diacetyl disulfide, diethanol sulfide, di-t-butyl trisulfide and dimethyl sulfoxide. Compounds used with preference as molecular weight regulators are mercapto compounds, dialkyl sulfides, dialkyl disulfides and/or diaryl sulfides. Examples of these compounds are ethyl thioglycolate, 2-ethylhexyl thioglycolate, pentaerythritol tetrathioglycolate, cysteine, 2-mercaptoethanol, 1,3-mercaptopropanol, 3-mercaptopropane-1,2-diol, 1,4-mercaptobutanol, mercaptoacetic acid, 3-mercaptopropionic acid, thioglycolic acid, mercaptosuccinic acid, thioglycerol, thioacetic acid, thiourea and alkyl mercaptans such as n-butyl mercaptan, n-hexyl mercaptan, t-dodecyl mercaptan or n-dodecyl mercaptan. Polymerization regulators used with particular preference are mercapto alcohols and mercapto carboxylic acids. In the context of the present invention, very particular preference is given to the use of n-dodecyl mercaptan and tert-dodecyl mercaptan as chain transferers.

In a particular aspect, the repeating units derived from phosphorus derivatives of a polar ethylenically unsaturated monomer in the polyalkyl(meth)acrylate are preferably obtained by a polymer-analogous reaction after the above-described preparation of a polyalkyl(meth)acrylate. Accordingly, it is possible with preference first to prepare a polymer with reactive polar units, the reactive units being reacted with a phosphorus compound of the type described above. The reactive polar units include especially anhydride or epoxide units.

The reaction of the reactive polar units present in the polymer, preferably of the anhydride or epoxide groups, with phosphorus compounds can be effected typically between 25° C. and 110° C. The phosphorus compound can preferably be added in an equimolar amount to the reactive polar groups, preferably to the anhydride or epoxide groups.

In a particular aspect of the present invention, in the lubricant composition usable in accordance with the invention, the content of polyalkyl(meth)acrylate having repeating units derived from ethylenically unsaturated monomers having at least one covalently bonded phosphorus atom may be in the range from 0.1 to 40% by weight, preferably in the range from 0.5 to 30% and especially preferably in the range from 2 to 15% by weight, based on the weight of the lubricant composition.

In a preferred embodiment of the lubricant composition usable in accordance with the invention, the lubricant composition is a phosphorus compound having a molecular weight not exceeding 1000 g/mol, preferably not exceeding 800 g/mol, more preferably not exceeding 600 g/mol.

In this context, it is especially preferable that the phosphorus compound having a molecular weight not exceeding 1000 g/mol is a phosphoric ester, a phosphoric thioester, a metal dithiophosphate, a phosphite, a phosphonate, a phosphine or a mixture of these compounds.

The preferred phosphorus compounds include, for example, trialkyl phosphates, triaryl phosphates, e.g. tricresyl phosphate, and especially amine-neutralized mono- and dialkyl phosphates. These are obtained by reaction of phosphorus pentoxide with alcohols, and the remaining acid groups in the molecule which have not reacted in spite of the excess of alcohol are neutralized with long-chain amines. The alkyl and/or aryl groups comprise preferably 1 to 40, more preferably 3 to 30 and especially preferably 4 to 20 carbon atoms. Alkyl groups in the long-chain amines with which remaining acid groups of the phosphoric acid derivatives can be reacted comprise preferably 4 to 40, more preferably 6 to 30 and especially preferably 8 to 20 carbon atoms.

Thiophosphates are generally obtained by reaction of phosphorus pentasulfide with appropriate alcohols. The remaining thiophosphoric acid group is then reacted either with a long-chain amine (=ashless thiophosphate) or a metal salt, for example zinc sulfate/hydroxide or molybdenum sulfate/hydroxide. The resulting ash-forming zinc-containing antiwear additives are generally referred to as zinc dialkyldithiophosphate, ZnDDP for short.

These additives are commercially available either as single components or in the form of formulations (i.e. mixture with other additives, for example antioxidants or detergents), for example NA-LUBE AW 6110 from KING-Industries (antiwear additive) or Additin RC 9200 from Rheinchemie (additive package).

It is also especially preferable here that the weight ratio of polyalkyl(meth)acrylate having repeating units derived from ethylenically unsaturated monomers having at least one covalently bonded phosphorus atom to phosphorus compound having a molecular weight not exceeding 1000 g/mol is in the range from 10 000:1 to 1:10 000, preferably in the range from 500:1 to 1:200 and especially preferably in the range from 100:1 to 1:1.

In addition, in the lubricant composition usable in accordance with the invention, the content of phosphorus compound having a molecular weight not exceeding 1000 g/mol may be in the range from 0.01 to 10% by weight, preferably in the range from 0.05 to 8% and especially preferably in the range from 0.1 to 4%, based on the weight of the lubricant composition.

As well as the above-detailed polymers, the lubricant compositions of the present invention comprise at least one lubricant oil, also called base oil. Lubricant oils include especially mineral oils, synthetic oils and natural oils.

Mineral oils are known per se and commercially available. They are generally obtained from mineral oil or crude oil by distillation and/or refining and optionally further purification and finishing processes, the term mineral oil including in particular the higher-boiling fractions of crude or mineral oil. In general, the boiling point of mineral oil is higher than 200° C., preferably higher than 300° C., at 5000 Pa. The production by low-temperature carbonization of shale oil, coking of bituminous coal, distillation of brown coal with exclusion of air, and also hydrogenation of bituminous or brown coal is likewise possible. Accordingly, mineral oils have, depending on their origin, different proportions of aromatic, cyclic, branched and linear hydrocarbons.

In general, a distinction is drawn between paraffin-base, naphthenic and aromatic fractions in crude oils or mineral oils, in which the term paraffin-base fraction represents longer-chain or highly branched isoalkanes, and naphthenic fraction represents cycloalkanes. In addition, mineral oils, depending on their origin and finishing, have different fractions of n-alkanes, isoalkanes having a low degree of branching, known as mono-methyl-branched paraffins, and compounds having heteroatoms, in particular O, N and/or S, to which a degree of polar properties are attributed. However, the assignment is difficult, since individual alkane molecules may have both long-chain branched groups and cycloalkane radicals, and aromatic parts. For the purposes of the present invention, the assignment can be effected according to DIN 51 378, for example. Polar fractions can also be determined according to ASTM D 2007.

The proportion of n-alkanes in preferred mineral oils is less than 3% by weight, the fraction of O-, N- and/or S-containing compounds less than 6% by weight. The fraction of the aromatics and of the mono-methyl-branched paraffins is generally in each case in the range from 0 to 40% by weight. In one interesting aspect, mineral oil comprises mainly naphthenic and paraffin-base alkanes which have generally more than 13, preferably more than 18 and most preferably more than 20 carbon atoms. The fraction of these compounds is generally 60% by weight, preferably ≥80% by weight, without any intention that this should impose a restriction. A preferred mineral oil contains 0.5 to 30% by weight of aromatic fractions, 15 to 40% by weight of naphthenic fractions, 35 to 80% by weight of paraffin-base fractions, up to 3% by weight of n-alkanes and 0.05 to 5% by weight of polar compounds, based in each case on the total weight of the mineral oil.

An analysis of particularly preferred mineral oils, which was effected by means of conventional processes such as urea separation and liquid chromatography on silica gel, shows, for example, the following constituents, the percentages relating to the total weight of the particular mineral oil used:

n-alkanes having approx. 18 to 31 carbon atoms:
0.7-1.0%,
slightly branched alkanes having 18 to 31 carbon atoms:
1.0-8.0%,
aromatics having 14 to 32 carbon atoms:
0.4-10.7%,
iso- and cycloalkanes having 20 to 32 carbon atoms:
60.7-82.4%,
polar compounds:
0.1-0.8%,
loss:
6.9-19.4%.

An improved class of mineral oils (reduced sulfur content, reduced nitrogen content, higher viscosity index, lower pour point) results from hydrogen treatment of the mineral oils (hydroisomerization, hydrocracking, hydrotreatment, hydro finishing). In the presence of hydrogen, this essentially reduces aromatic components and builds up naphthenic components.

Valuable information with regard to the analysis of mineral oils and a list of mineral oils which have a different composition can be found, for example, in T. Mang, W. Dresel (eds.): "Lubricants and Lubrication", Wiley-VCH, Weinheim 2001; R. M. Mortier, S. T. Orszulik (eds.): "Chemistry and Technology of Lubricants", Blackie Academic & Professional, London, 2nd ed. 1997; or J. Bartz: "Additive für Schmierstoffe", Expert-Verlag, Renningen-Malmsheim 1994.

Synthetic oils include organic esters, for example diesters and polyesters, polyalkylene glycols, polyethers, synthetic hydrocarbons, especially polyolefins, among which preference is given to polyalphaolefins (PAOs), silicone oils and perfluoroalkyl ethers. In addition, it is possible to use synthetic base oils originating from gas to liquid (GTL), coal to liquid (CTL) or biomass to liquid (BTL) processes. They are usually somewhat more expensive than the mineral oils, but have advantages with regard to their performance.

Natural oils are animal or vegetable oils, for example neatsfoot oils or jojoba oils.

Base oils for lubricant oil formulations are divided into groups according to API (American Petroleum Institute). Mineral oils are divided into group I (non-hydrogen-treated) and, depending on the degree of saturation, sulfur content and viscosity index, into groups II and III (both hydrogen-treated). PAOs correspond to group IV. All other base oils are encompassed in group V.

These lubricant oils may also be used as mixtures and are in many cases commercially available.

A preferred embodiment of the lubricant composition usable in accordance with the invention envisages that the lubricant composition includes preferably at least 40% by weight, more preferably at least 50% by weight and especially preferably at least 60% by weight of a base oil. A particularly preferred base oil may be a group I oil, group II oil, group III oil or a polyalphaolefin, or a mixture of these oils.

As well as the above-detailed components, an inventive lubricant composition may comprise further additives. These include antiwear (AW) and extreme pressure (EP) additives, for example zinc bis(amyldithiocarbamate) or methylenebis(di-n-butyl dithiocarbamate); sulfur compounds containing elemental sulfur and $H_2S$-sulfurized hydrocarbons (disobutylene, terpene); sulfurized glycerides and fatty acid esters; VI improvers; dispersants; defoamers; corrosion inhibitors; antioxidants and friction modifiers.

Moreover, it is a particular aspect of the present invention that a polyalkyl(meth)acrylate having repeating units derived from ethylenically unsaturated monomers having at least one covalently bonded phosphorus atom finds use for reducing friction.

The invention is illustrated in detail hereinafter by examples, without any intention that this should impose a restriction.

EXAMPLES AND COMPARATIVE EXAMPLES

One possible embodiment of the invention is illustrated in the example below, without narrowing or delimiting the scope of the invention.

Synthesis, Inventive Example

A reaction flask equipped with heating mantle, internal temperature regulator, stirrer, nitrogen inlet and condenser was initially charged with 112.5 g of polymerization oil, 11.88 g of lauryl methacrylate (LMA), 0.51 g of glycidyl methacrylate (GMA) and 0.11 g of n-dodecyl mercaptan (nDDM), which were heated to 100° C. with introduction of nitrogen. On attainment of the reaction temperature, the reaction was commenced by addition of 0.11 g of tBPO (tert-butyl perbenzoate). At the same time, a mixture consisting of 237.55 g of LMA, 10.23 g of GMA, 2.23 g of nDDM and 0.63 g of tBPO was metered in homogeneously within 3.5 hours. After 2 and 4 hours after the end of feeding, another 0.53 g in each case of tBPO was added and stirring was continued for 18 hours. This was followed by cooling 30° C., addition of 166.07 g of dilution oil and dropwise addition of 16.61 g of DBP (di-n-butyl phosphate). The mixture was stirred at 30° C. for another 1 hour, then heated to 40° C. and kept at 40° C. for a further 3 hours. In order to ensure complete conversion, the mixture was then heated to 100° C. and stirred for a further 12 hours. This gave rise to repeating units derived from phosphorus derivatives of a polar ethylenically unsaturated monomer, and the content of these repeating units was about 9.6% by weight.

The above-described polymer comprised LMA-co-GMA/DBP=90.4-3.9/5.7% by weight.

Synthesis, Comparative Example 1

A reaction flask equipped with heating mantle, internal temperature regulator, stirrer, nitrogen inlet and condenser was initially charged with 112.43 g of polymerization oil, 169.41 g of LMA (lauryl methacrylate), 54.73 g of SMA (alkyl methacrylate having 16 to 18 carbon atoms in the alkyl radical), 1.30 g of DPMA (alkyl methacrylate having 12 to 15 carbon atoms in the alkyl radical), 35.18 g of methyl methacrylate (MMA) and 1.95 g of nDDM, which were heated to 110° C. with the introduction of nitrogen. On attainment of the reaction temperature, 0.13 g of a 25% solution of tBPO in oil was metered in homogeneously over 1 h. Thereafter, 0.65 g of a 25% solution of tBPO was added within a second hour, and 1.82 g of the 25% solution of tBPO within a third hour. One hour after the feeding had ended, 0.52 g of tBPO was added and then stirring was continued at 110° C. for 2 h.

The above-described polymer comprised LMA-co-SMA-DPMA-MMA=65-21-0.5-13.5% by weight Synthesis, Comparative Example 2

A reaction flask equipped with heating mantle, internal temperature regulator, stirrer, nitrogen inlet and condenser was initially charged with 171.4 g of polymerization oil, 17.8 g of LMA, 1.2 g of DMAEMA and 0.13 g of nDDM, which were heated to 100° C. with introduction of nitrogen. On attainment of the reaction temperature, the reaction was commenced by addition of 0.17 g of tBPO; at the same time, a mixture consisting of 357.3 g of LMA, 23.7 g of GMA, 2.67 g of nDDM and 0.95 g of tBPO was metered in homogeneously within 3.2 hours. 2 and 4 h hours after the end of feeding, another 0.80 g of tBPO was added and stirring was continued for 18 hours. Subsequently, 228.6 g of dilution oil were added.

After cooling to 40° C., 6.0 g of unneutralized NA-LUBE AW-6110 were added. After stirring for a further 45 min, 6.0 g of the unneutralized NA-LUBE AW-6110 (mixture of mono- and dialkyl phosphate with an average of 1.5 acid groups per molecule; the alkyl groups are 80% octyl and 20% decyl groups) were again added. Subsequently, the temperature was increased stepwise: to 50° C. after 90 min, to 60° C. after a further 60 min and then to 70° C. after a further 60 min. At this temperature, stirring was continued for a further 15 h.

The above-described polymer comprised LMA-co-DMAEMA=93.8-6.2% by weight

Synthesis, Comparative Example 3

A reaction flask equipped with heating mantle, internal temperature regulator, stirrer, nitrogen inlet and condenser was initially charged with 21.6 g of polymerization oil, 241.8 g of LMA, 19.7 g of MOEMA (2-morpholinoethyl methacrylate), 0.5 g of DPMA, 0.5 g of SMA and 3.9 g of nDDM, which were heated to 110° C. while introducing nitrogen. On attainment of the reaction temperature, 0.26 g of a 10% solution of tBPO in oil was metered in homogeneously over 1 h. Thereafter, 1.31 g of a 10% solution of tBPO were added over a further hour, and 3.66 g of this 10% solution of tBPO within the third hour. One and two hours after the end of feeding, 0.53 g each time of tBPO was added and then stirring was continued at 110° C. for 15 h. Thereafter, 236.2 g of dilution oil were added and stirring was continued for a further hour.

50 g of this polymer solution were transferred to a 100 ml beaker. At room temperature, 1.98 g of DBP (dibutyl phosphate) were added while stirring (magnetic stirrer with hotplate). This mixture is heated to 60° C. and stirred at this temperature for a further 20 min.

The above-described polymer comprised LMA-co-DPMA-SMA-MOEMA=92.1-0.2-0.2-7.5% by weight Methods for Characterization of the Inventive Polymers:

a) MTM (Mini Traction Machine) Measurement, Friction Value Measurement

The friction value measurements were conducted on a mini traction machine from PCS Instruments under the following conditions:

| | |
|---|---|
| Test rig | MTM 2 from PCS Instruments |
| Disk | Steel, AISI 52100, diameter = 46 mm, RMS = 25-30 nm, Rockwell C hardness = 63, the elastic modulus = 207 GPa |
| Ball | Steel, AISI 52100, diameter = 19.05 mm, RMS = 10-13 nm, Rockwell C hardness = 58-65, the elastic modulus = 207 GPa |
| Speed | 5-2500 mm/s |
| Temperature | 100° C. |
| Load | 30 N = max. Hertzian contact pressure 0.95 GPa |
| Sliding/ rolling ratio | 50% |

The evaluation of the friction value measurements in the form of a graph is shown in diagram 2. A quantifiable result for which the reduction in friction can be expressed as a number is obtained by integrating the friction value curves in the range of sliding speed 5-2500 mm/s. The area corresponds to the "total friction" in the overall speed range examined. The smaller the area, the greater the friction-reducing effect of the polymer examined. The areas determined are summarized in table 2.

b) Wear Test on a 4-Ball Apparatus

The Shell four-ball apparatus (VKA) is a test instrument standardized in DIN 51 350 Part 1 for determination of the weld load and good load (DIN 51 350 Parts 2 and 3) and of various friction and wear characteristics of lubricants (DIN 51 350 Parts 3 and 5). In the standard test, a rotating ball-bearing ball is pressed under load onto three identical but stationary balls. The test system is widespread particularly in the lubricants industry and is used routinely therein for product development and quality control.

Wear is determined by visual measurement of the spherical caps formed. The mean is formed for the individually measured spherical cap diameters for the load stage (300N). The end result reported is the mean (multiplied by the enlargement correction factor for the eyepiece).

Characterization:

a) Wear Characteristics in the VKA Test

The inventive polymer and those of comparative examples 1 and 3 were a 13.35% solution in 100N oil prepared (KV100=5.30 $mm^2/s$, 750 ppm of phosphorus in solution) and analyzed twice at the 300N load stage.

TABLE 1

Results of the VKA wear test

| | Example | Comparative example 1 | Comparative example 3 |
|---|---|---|---|
| Load | 300 N | 300 N | 300 N |
| Ball 1 | 0.23/0.25 | 0.42/0.43 | 0.42/0.43 |
| Ball 2 | 0.20/0.20 | 0.45/0.45 | 0.43/0.44 |
| Ball 3 | 0.23/0.25 | 0.47/0.47 | 0.43/0.44 |
| Ball 4 | 0.25/0.23 | 0.47/0.47 | 0.43/0.43 |

TABLE 1-continued

| Results of the VKA wear test | | | |
|---|---|---|---|
| | Example | Comparative example 1 | Comparative example 3 |
| Ball 5 | 0.25/0.25 | 0.50/0.52 | 0.44/0.44 |
| Ball 6 | 0.27/0.28 | 0.53/0.53 | 0.42/0.42 |
| Average | 0.23/0.25 | 0.47/0.48 | 0.43/0.43 |
| Result [mm] | 0.24 | 0.48 | 0.43 |
| Conversion factor 1.67 | | | |

On comparison of the two polymers, a distinct improvement in wear characteristics was found for the inventive polymer compared to the reference polymer.

b) Friction Value Measurement

For the friction value measurement, both the inventive polymer and reference polymers 1 and 3 were adjusted to a KV100 of 9.50 $mm^2/s$ in a mixture of APE Core 80N:APE Core 150N=70:30. In addition, the two polymers were analyzed in the same oil mixture but with addition of 0.9% by weight of a commercially available, ashless, phosphorus-containing antiwear package (AW additive).

TABLE 2

| Quantitative evaluation of the friction values | | | | |
|---|---|---|---|---|
| | Example | Example with additive (DI) | Comparative example 1 | Comparative example 1 with additive (DI) |
| Area in mm/s | 76.36 | 74.77 | 78.18 | 81.78 |
| Change resulting from addition of AW additive in % | | −2.1 | | +4.6 |
| % change based on comparative example + AW additive | | −8.6 | | |

| | Comparative example 2 | Comparative example 2 with additive (DI) |
|---|---|---|
| Area in mm/s | 78.51 | 90.10 |
| Change resulting from addition of AW additive in % | | +14.76 |

As is clear from the measurement of the comparative example, the addition of an antiwear additive typically worsens the coefficient of friction. For the inventive polymer, in contrast, a distinct improvement is achieved.

The inventive lubricant composition is defined by the characterizing features of the appended claims.

The invention claimed is:

1. A lubricant composition, comprising:

a phosphorus compound having a molecular weight not exceeding 1000 g/mol; and a polyalkyl(meth)acrylate having a weight-average molecular weight $M_w$ of from 10,000 to 600,000 g/mol and comprising a repeating unit derived from a (meth) acrylate having 6 to 22 carbon atoms in an alcohol radical, wherein:

the polyalkyl(meth)acrylate is a random copolymer and comprises a repeating unit derived from an ethylenically unsaturated monomer comprising a covalently bonded phosphorus atom;

the ethylenically unsaturated monomer comprising a covalently bonded phosphorus atom is at least one selected from the group consisting of 2-(dimethylphosphato)-3-hydroxypropyl (meth)acrylate, 2-(ethylenephosphito)-3-hydroxypropyl (meth)acrylate, 3-(meth) acryloyloxy-2-hydroxypropyl diethyl phosphonate, 3-(meth)acryloyloxy-2-hydroxypropyl dipropyl phosphonate, 3-(dimethylphosphato)-2-hydroxypropyl (meth)acrylate, 3-(ethylenephosphito)-2-hydroxypropyl (meth)acrylate, 2-(meth)acryloyloxy-3-hydroxypropyl diethyl phosphonate, 2-(meth)acryloyloxy-3-hydroxypropyl dipropyl phosphonate, and 2-(dibutylphosphono)-3-hydroxypropyl (meth)acrylate; and the polyalkyl(meth)acrylate has a content of from 0.2 to 0.9% by weight of phosphorus atoms, based on a weight of the polyalkyl(meth)acrylate.

2. The lubricant composition as claimed in claim 1, wherein the phosphorus compound having a molecular weight not exceeding 1000 g/mol is a phosphoric ester, a phosphoric thioester, a metal dithiophosphate, a phosphite, a phosphonate, a phosphine, or a mixture of these compounds.

3. The lubricant composition as claimed in claim 1, wherein a weight ratio of the polyalkyl(meth)acrylate comprising a repeating unit derived from an ethylenically unsaturated monomer comprising a covalently bonded phosphorus atom to the phosphorus compound having a molecular weight not exceeding 1000 g/mol is from 10,000:1 to 1:10,000.

4. The lubricant composition of claim 1, wherein a content of the phosphorus compound having a molecular weight not exceeding 1000 g/mol is from 0.01 to 10% by weight, based on a weight of the lubricant composition.

5. The lubricant composition of claim 1, wherein a content of the polyalkyl(meth)acrylate is from 0.1 to 40% by weight, based on a weight of the lubricant composition.

6. The lubricant composition of claim 1, further comprising at least 50% by weight of a base oil.

7. The lubricant composition as claimed in claim 6, wherein the base oil is a group I oil, group II oil, group III oil, a polyalphaolefin, or a mixture of these oils.

8. A polyalkyl(meth)acrylate, comprising a repeating unit derived from a (meth)acrylate having 6 to 22 carbon atoms in an alcohol radical, wherein:

the polyalkyl(meth)acrylate comprises a repeating unit derived from a phosphorus derivative of a polar ethylenically unsaturated monomer, the phosphorus derivative of a polar ethylenically unsaturated monomer is at least one selected from the group consisting of 2-(dimethylphosphato)-3-hydroxypropyl (meth)acrylate, 2-(ethylenephosphito)-3-hydroxypropyl (meth)acrylate, 3-(meth)acryloyloxy-2-hydroxypropyl diethyl phosphonate, 3-(meth)acryloyloxy-2-hydroxypropyl dipropyl phosphonate, 3-(dimethylphosphato)-2-hydroxypropyl (meth)acrylate, 3-(ethylenephosphito)-2-hydroxypropyl (meth) acrylate, 2-(meth)acryloyloxy-3-hydroxypropyl diethyl phosphonate, 2-(meth)acryloyloxy-3-hydroxypropyl dipropyl phosphonate, and 2-(dibutylphosphono)-3-hydroxypropyl (meth)acrylate, the polyalkyl(meth)acrylate is a random copolymer, and the polyalkyl(meth)acrylate is suitable for a lubricant composition.

9. The polyalkyl(meth)acrylate as claimed in claim 8, wherein a content of phosphorus atoms, based on a weight of the polyalkyl(meth)acrylate, is from 0.2 to 0.9% by weight.

* * * * *